United States Patent [19]

Yamagishi et al.

[11] 4,046,604

[45] Sept. 6, 1977

[54] METHOD FOR CONTINUOUSLY QUENCHING ELECTROLYTIC TIN-PLATED STEEL STRIP WHILE PREVENTING QUENCH STAINS

[75] Inventors: Hidehisa Yamagishi; Mizuo Tanaka, both of Yokohama, Japan

[73] Assignee: Nippon Kokan Kabushiki Kaisha, Tokyo, Japan

[21] Appl. No.: 669,838

[22] Filed: Mar. 24, 1976

[30] Foreign Application Priority Data

Apr. 30, 1975 Japan ..... 50-52216

[51] Int. Cl.[2] ..... C21D 9/52; C25D 5/50

[52] U.S. Cl. ..... 148/156; 148/157; 204/37 T

[58] Field of Search ..... 148/153, 156, 155, 143, 148/157; 204/36, 37 T

[56] References Cited

U.S. PATENT DOCUMENTS 3,410,734 11/1968 Taylor ..... 148/153

*Primary Examiner*—R. Dean

*Attorney, Agent, or Firm*—Flynn & Frishauf

[57] ABSTRACT

Streams of quenching liquid are uniformly sprayed onto both surfaces of a continuously electrolytic tinplated steel strip, having a tin-plated layer fused by heating in a heating furnace, in moving substantially vertically downward, said streams of quenching liquid being sprayed on substantially the same horizontal level over the entire width of said strip in the air above the surface of quenching liquid in a quenching tank, thereby quenching said strip to solidify said fused tin-plated layer, said streams of quenching liquid being sprayed with the use of two spray nozzles under the following conditions:

1. Spraying angle of the quenching liquid from said spray nozzles: 45° to 75° downward against said strip,
2. Pressure of the quenching liquid sprayed from said spray nozzles: 0.05 kg/cm² to 4.0 kg/cm², and
3. Position where the quenching liquid sprayed from said spray nozzles first comes in contact with said strip: in the air at least 25 mm above the surface of quenching liquid in said quenching tank;

said spray nozzles being of double-tube construction, said spray nozzles having a longitudinal slit through said strip, and said spray nozzles being located one opposite the other symmetrically on both sides of said strip in moving substantially vertically downward, in parallel therewith and on substantially the same horizontal level, in the air above the surface of quenching liquid in said quenching tank; then, immediately, said strip is directed further substantially vertically downward and is passed through the quenching liquid in said quenching tank, thereby further quenching said strip.

2 Claims, 4 Drawing Figures

METHOD FOR CONTINUOUSLY QUENCHING ELECTROLYTIC TIN-PLATED STEEL STRIP WHILE PREVENTING QUENCH STAINS

FIELD OF THE INVENTION

The present invention relates to a method for continuously quenching a continuously electrolytic tin-plated steel strip in moving, while preventing the occurrence of quench stains on the surface of the tin-plated layer of said strip, on causing rapid fusion and rapid solidification of the tin-plated layer of said strip in moving for brightening the surface of the tin-plated layer of said strip.

BACKGROUND OF THE INVENTION

The surface of the tin-plated layer of an electrolytic tin-plated steel strip as plated by the conventional continuous electrolytic tin-plating method is mat and has no gloss. In order to brighten the surface of the thus tin-plated layer, it is a usual practice to heat said strip in a heating furnace for rapidly fusing the tin-plated layer thereof, and then, immediately, to quench said strip in a quenching tank to cause rapid solidification of said fused tin-plated layer.

If the quenching is improperly applied, however, dirt patterns which look like dried stains of dirty water (hereinafter referred to as "quench stain") are produced on the surface of the tin-plated layer of said strip, considerably reducing the commercial value of the strip. Said quench stains are produced by an unevenly quenched tin-plated layer due to an irregular quenching rate caused by the non-uniform contact between the strip and the quenching liquid, which is brought about by surface turbulence of the quenching liquid in the quenching tank on introducing the strip into it, splashes of quenching liquid onto the strip, and uneven deposit of a steam film, which is generated by quenching, on the strip.

With a view to preventing the production of the above-mentioned quench stains, there have been a number of proposals. In a method disclosed in U.S. Pat. No. 3,358,980, for instance, two compartments with a hood and space plates are installed in a quenching tank, and surface turbulence on the surface of quenching liquid in the quenching tank caused by the incoming strip is prevented with the use of said spaced plates. Besides, a narrow region is confined by said spaced plates. The heated strip is directed into this narrow region. The quenching liquid first fed into said compartments, and after flowing under the lower end of a spaced plate and over the upper end of the other spaced plate, flows down into the quenching tank by gravity along both surfaces of the strip, in the same direction as the travel of the strip, and almost in parallel with the strip, in said narrow region, and after filling up the quenching tank, the quenching liquid overflows. Initially, the strip, brought into contact with the quenching liquid in said narrow region, is quenched at a relatively slow quenching rate, and secondly is moved into the quenching tank and quenched down to a prescribed temperature. Further, a temperature sensing device is provided in said narrow region to control the quenching liquid temperature.

According to the above-mentioned method, no surface turbulence is produced on the surface of the quenching liquid in the quenching tank on introducing the strip into it, so that the tin-plated layer is quenched uniformly, permitting prevention of quench stains. However, in this method, because the quenching liquid comes into contact with the strip while flowing down in said narrow region by gravity, the impact of the quenching liquid against the strip is small. Nevertheless, with the recent speeding-up of a continuous electrolytic tin-plating line, the moving speed of strip has been accelerated up to some 300 - 450 m/min. Accordingly, quenching capacity obtained only by a stream of quenching liquid by gravity as is the case of this method is insufficient. With an insufficient quenching capacity, steam generated at the interface between the strip and the quenching liquid accompanies the strip, being deposited on the surface of the strip. As a result, irregularity is found in the quenching rate of the tin-plated layer, which is not uniformly quenched, so that it is impossible to completely prevent the occurrence of quench stains. In other words, this method is not applicable to a high-speed continuous electrolytic tin-plating line. Besides, it is necessary to provide the quenching tank with a hood, spaced plates and compartments, leading to increased costs of quenching facilities.

Further, in the method disclosed in U.S. Pat. No. 3,410,734, an elongated conduit section of rectangular cross-section which provides a restricted quench channel extends upwardly from a quenching tank. A quenching liquid supplied into the quenching tank, after filling up the quenching tank, comes up in said restricted quench channel and flows over its upper end into a trough. Closely adjacent the upper end of said restricted quench channel, a plurality of submerged jet or spray units are provided for directing streams of quenching liquid toward the strip across the entire width thereof. A heated steel strip moves vertically downward from a heating furnace and enters the restricted quench channel where it is immediately immersed in the upwardly flowing stream of quenching liquid. In addition, the submerged jet or spray units direct streams of quenching liquid against the strip in a direction generally normal to the strip. Said submerged jet or spray units use a large quantity of quenching liquid with a relatively low pressure of about 1.4 - 2.1 kg/cm$^2$.

According to the above-mentioned method, the strip can be quenched over the entire width thereof uniformly and at a high rate. Therefore, this method is applicable, in particular, for obtaining strips having martensitic microstructure and superior in flatness. However, this method has no special regard for the prevention of quench stains. The method has another disadvantage of requiring a complicated quenching device which increases the installation costs.

There is also known a method which comprises fusing the tin-plated layer of a continuously electrolytic tin-plated steel strip in a heating furnace, for the purpose of improving the corrosion resistance on either the upper or under surface of said strip, then spraying quenching liquid on either the upper or under surface of said strip, in the air or below the surface of the quenching liquid in a quenching tank, thus quenching slowly while holding a temperature differential between both surfaces of said strip, to coarsen the grain size of tin on one surface of said strip (refer to the Japanese Patent Publication No. 6.641/67).

In this method, in which the quenching liquid is sprayed only on one surface of the strip, the quenching capacity is insufficient, and no regard is given to uniform quenching of the strip over the entire width thereof. That is, in this method, increasing the pressure or the volume of water of submerged spray in the quenching tank in an attempt to improve the quenching capacity brings more serious surface turbulence of quenching liquid in the quenching tank without permitting uniform quenching of the strip over the entire width thereof, resulting in the impossibility of preventing the production of quench stains. Moreover, quenching in the air by this method aims merely at controlling tin crystal, with no regard to uniform quenching of the strip over the entire width thereof.

As mentioned above, in view of the fact that the conventional methods for quenching a continuously electrolytic tin-plated steel strip and for preventing quench stains thereon are unable to prevent the occurrence of quench stains in a satisfactory manner, there have been proposed the following two methods:

1. A method for continuously quenching a continuously electrolytic tin-plated steel strip in moving, which comprises applying a first-step quenching at a relatively low rate to spray streams of quenching liquid mist onto a continuously electrolytic tin-plated steel strip with the tin-plated layer thereof fused by heating, in the air above the surface of the quenching liquid in a quenching tank, and immediately after said first-step quenching, applying a second-step quenching at a relatively high rate to spray high-pressure and large quantity streams of quenching liquid onto the surface of said strip below the surface of said quenching liquid in said quenching tank, thereby preventing the occurrence of quench stains on the surface of the tin-plated layer of said strip (refer to the Japanese Patent Provisional Publication No. 74,532/75); and 2. A method for continuously quenching a continuously electrolytic tin-plated steel strip in moving, which comprises applying a first-step quenching at a relatively low rate to spray high-pressure streams of quenching liquid along a guide plate onto a continuously electrolytic tin-plated steel strip with the tin-plated layer thereof fused by heating, in the air above the surface quenching liquid in a quenching tank, and immediately after said first-step quenching, applying a second-step quenching at a relatively high rate to spray high-pressure and large quantity streams of quenching liquid onto the surface of said strip below the surface of the quenching liquid in said quenching tank, thereby preventing the occurrence of quench stains on the surface of the tin-plated layer of said strip (refer to the Japanese Patent Provisional Publication No. 75,131/76).

According to the above-mentioned methods (1) and (2) it is possible to largely minimize the occurrence of quench stains on causing rapid fusion and rapid solidification of the tin-plated layer of a continuously electrolytic tin-plated steel strip. In said method (1), however, in which a quenching liquid mist is sprayed onto the strip in the first-step quenching, the large amount of heat contained in the strip heated in a heating furnace may lead to a shortage in the quenching capacity.

Furthermore, in said methods (1) and (2), streams of quenching liquid are sprayed onto the strip, using a plurality of spray nozzles provided over the entire strip width symmetrically on the both sides of said strip in moving substantially vertically downward and on substantially the same horizontal level. This makes it difficult to maintain a constant pressure and a constant flow rate of the sprayed quenching liquid in the strip width direction under the effect of the mutual interference between the streams of quenching liquid sprayed from different spray nozzles located adjacent to each other. More specifically, each stream of quenching liquid sprayed from a spray nozzle diverges more at a longer distance from the nozzle hole, so that the distribution of quenching liquid becomes non-uniform between the center and the peripheral portions of each stream. This non-uniformity of the quenching liquid distribution for each spray nozzle is more serious accordingly as the quenching liquid pressure becomes higher. Even if it is attempted to keep a uniform quenching liquid distribution for each spray nozzle in the strip width direction by adjusting the number of spray nozzles and/or the intervals between spray nozzles, a change in the quenching liquid pressure leads to a corresponding change in the overlapping pattern of adjacent streams of quenching liquid, and hence to a local change in the amount of sprayed quenching liquid in the strip width direction. In said methods (1) and (2) mentioned above, therefore, it is not always easy to quench a strip uniformly over the entire width thereof on substantially the same horizontal level.

In view of the foregoing, although said methods (1) and (2) are successful in largely reducing quench stains occurring on the rapid fusion and the rapid solidification of the tin-plated layer of a continuously electrolytic tin-plated steel strip, sufficiently satisfactory effects have not as yet been obtained.

SUMMARY OF THE INVENTION

A principal object of the present invention is therefore to provide an improvement in the method for continuously quenching a moving continuously electrolytic tin-plated steel strip while preventing the occurrence of quench stains on the surface of the tin-plated layer of said strip as it moves by causing a rapid fusion and a rapid solidification of said tin-plated layer for brightening the surface of said tin-plated layer of said strip.

In accordance with one of the features of the present invention, there is provided an improvement in the method for continuously quenching a moving continuously electrolytic tin-plated steel strip while preventing quench stains, which comprises spraying streams of quenching liquid uniformly onto both surfaces of a continuously electrolytic tin-plated steel strip, having a tin-plated layer fused by heating in a heating furnace, in moving substantially vertically downward from said heating furnace, said streams of quenching liquid being sprayed on substantially the same horizontal level over the entire width of said strip, in the air below said heating furnace and above the surface of quenching liquid in a quenching tank located below said heating furnace, thereby quenching said strip to solidify said fused tin-plated layer; and then, immediately, directing said strip further substantially vertically downward and passing said strip through the quenching liquid in said quenching tank, thereby further quenching said strip; said improvement characterized by comprising: spraying the streams of quenching liquid uniformly onto both surfaces of said strip with the use of two spray nozzles under the following conditions:

1. Spraying angle of the quenching liquid from said spray nozzles: 45° to 75° downward against said strip, 2. Pressure of the quenching liquid sprayed from said spray nozzles: 0.05 kg/cm$^2$ to 4.0 kg/cm$^2$, and 3. Position where the quenching liquid sprayed from said spray nozzles first comes in contact with said strip: in the air below said heating furnace and at least 25 mm above the surface of quenching liquid in said quenching tank;

said spray nozzles being double-tube construction based on the concentric combination of an inner tube and an outer tube, said spray nozzles having a longitudinal slit of a length substantially equal to the width of said strip through which the streams of quenching liquid are sprayed onto said strip, and said spray nozzles being located one opposite the other symmetrically on both sides of said strip in moving substantially vertically downward, in parallel therewith and on substantially the same horizontal level, in the air below said heating furnace and above the surface of quenching liquid in said quenching tank.

BRIEF DESCRIPTION OF THE DRAWINGS

The present invention is illustrated by way of examples in the accompanying drawings which form part of this application and in which.

DETAILED DESCRIPTION OF PREFERRED EMBODIMENT

Figure 1:
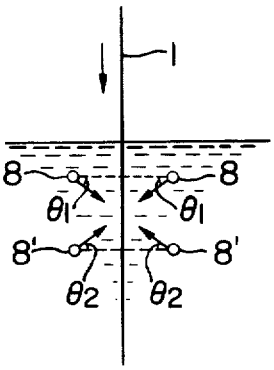
FIG. 1 is a sectional view schematically illustrating one of the conventional methods for quenching a continuously electrolytic tin-plated steel strip having a tin-plated layer fused by heating.

We have carried out a test as described below on the conventional method for quenching a continuously electrolytic tin-plated steel strip comprising spraying streams of quenching liquid onto both surfaces of said strip as it is moved substantially vertically downward, having a tin-plated layer fused by heating, in the quenching liquid in a quenching tank: As shown in the schematic sectional view of FIG. 1, upper and lower groups of spray nozzles 8 and 8' were installed symmetrically below the surface of the quenching liquid in a quenching tank on the both sides of a continuously electrolytic tin-plated steel strip 1, having a tin-plated layer fused by heating, in moving substantially vertically downward. Said upper and lower groups of spray nozzles 8 and 8' were respectively composed of a plurality of spray nozzles arranged in a row on the same horizontal level. The spray nozzles of said upper spray nozzle group 8 has a certain downward spraying angle $\theta_1$ against the horizontal direction, whereas the spray nozzles of said lower spray nozzle group 8' had a certain upward spraying angle $\theta_2$ against the horizontal direction. Streams of quenching liquid were then simultaneously sprayed onto said strip 1 from said upper and lower spray nozzle groups 8 and 8' in a case with $\theta_1$ of 20° to 45° and $\theta_2$ of 0° to 5° and in another case with $\theta_1$ of 50° and $\theta_2$ of 30°, respectively.

According to the above-mentioned test, it was possible to keep a flat surface of quenching liquid with only a slight turbulence of the quenching liquid surface in the quenching tank. However, insufficient impact of the quenching liquid against the strip 1 at the point where the strip 1 comes first in contact with the quenching liquid caused the occurrence of quench stains over the entire surface of the strip 1, and the spraying of quenching liquid below the surface of quenching liquid in a quenching tank as mentioned above was thus found to be insufficient for the purpose of preventing the occurrence of quench stains.

In the present invention, therefore, in view of the aforementioned facts, a continuously electrolytic tin-plated steel strip, having a tin-plated layer fused by heating in a heating furnace, is uniformly quenched over the entire width thereof on substantially the same horizontal level, by spraying streams of quenching liquid uniformly onto the both surfaces of said strip over the entire width thereof on substantially the same horizontal level in the air above the surface of quenching liquid in a quenching tank installed below said heating furnace, before said strip travels substantially vertically downward and enters the quenching liquid in said quenching tank.

In the present invention, furthermore, in order to avoid the above-mentioned drawback in the conventional method caused by the use of a plurality of spray nozzles, streams of quenching liquid are sprayed, as mentioned above onto the both surfaces of said strip with the use of two spray nozzles each having a longitudinal slit of a length substantially equal to the width of said strip. Said two spray nozzles are installed one opposite the other symmetrically on both sides of said strip as it moves substantially vertically downward, in parallel therewith and on substantially the same horizontal level, in the air below said heating furnace and above the surface of said quenching liquid.

Now, the present invention is described more in detail with reference to the drawings.

Figure 2:
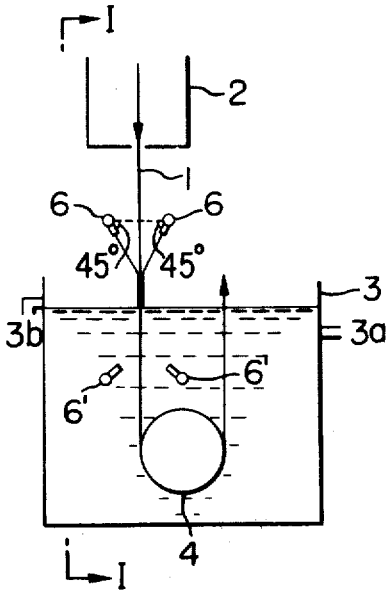
FIG. 2 is a sectional view schematically illustrating an apparatus used in the application of the present invention.
Figure 3:
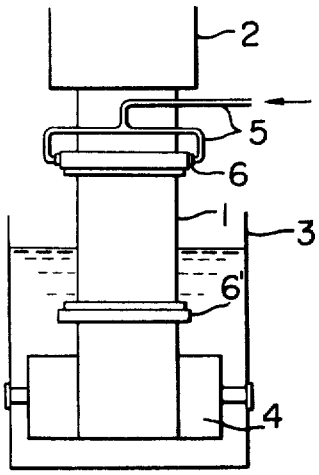
FIG. 3 is a sectional view of the apparatus in FIG. 2 cut along line I—I.

FIG. 2 is a sectional view schematically illustrating an apparatus used for implementation of the present invention, and FIG. 3 is a sectional view of FIG. 2 cut along line I—I. In FIGS. 2 and 3, 1 is a continuously electrolytic tin-plated steel strip, which moves in the direction indicated by the arrows; 2 is a heating furnace; 3 is a quenching tank, which is installed below the heating furnace 2 and is provided with a quenching liquid inlet 3*a* and an outlet 3*b*; 4 is a sinker roller supported on the quenching tank 3 by a watertight bearing (not shown); 5 is a quenching liquid feed pipe connected with spray nozzles 6; said two spray nozzles 6 being located one opposite the other symmetrically on both sides of strip 1 in moving substantially vertically downward, in parallel therewith and on substantially the same horizontal level, in the air below the heating furnace 2 and above the surface of quenching liquid in the quenching tank 3; 6' are submerged spray nozzles installed below the surface of quenching liquid in the quenching tank 3, said submerged spray nozzles 6' being located like said spray nozzles 6, one opposite the other symmetrically on both sides of the strip 1 in parallel therewith and on substantially the same horizontal level.

As shown in FIGS. 2 and 3, the continuously electrolytic tin-plated steel strip 1, after the tin-plated layer thereof is fused by heating at about 240° C to about 300° C while passing through the heating furnace 2, comes down substantially vertically, and is uniformly quenched by quenched liquid sprayed through the spray nozzles 6, in the air above the surface of the quenching liquid in the quenching tank 3, and said fused tin-plated layer is solidified.

Figure 4:
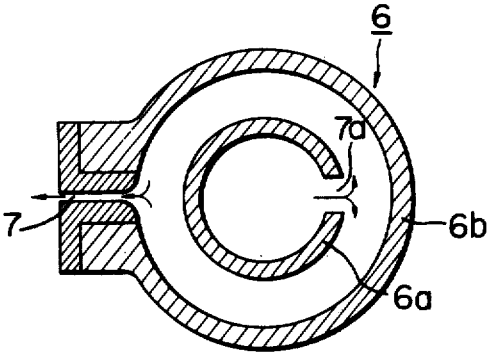
FIG. 4 is a sectional view of a spray nozzle having a single nozzle hole in the form of slit, in the present invention.

Said spray nozzles 6 are of double-tube construction based on the concentric combination of an inner tube 6*a* and an outer tube 6*b*, as shown in the sectional view of FIG. 4. A slit 7*a* is provided in the inner tube 6*a* along the axial direction thereof. Another slit 7 of a smaller width than that of said slit 7*a* is provided in the outer tube 6b on the opposite side of said slit 7a in the inner tube 6a. Said slits 7a and 7 have a length substantially equal to the width of the strip 1 to be quenched.

The quenching liquid, fed through the quenching liquid feed pipe 5 (shown in FIG. 3) and both ends of the spray nozzle 6 into the inner tube 6a, passes through the slit 7a of the inner tube 6a and enters the gap between the inner tube 6a and the outer tube 6b, and is then sprayed through the slit 7 of the outer tube 6b onto both surfaces of the stripo 1 to be quenched vigorously as if it were a single sheet.

The pressure of the quenching liquid sprayed through said slit 7 of the spray nozzle 6 should be within the range of 0.05 to 4.00 kg/cm². A pressure of under 0.05 kg/cm² leads to an insufficient impact of the quenching liquid against the strip 1 to be quenched to permit prevention of the occurrence of quench stains. A pressure of over 4.00 kg/cm², on the other hand, causes splashes by an excessive impact of the quenching liquid against the strip 1, thus resulting in a non-uniform quenching in the width direction of the strip 1 on substantially the same horizontal level and hence in the occurrence of quench stains. Better results can therefore be obtained by employing a pressure of the quenching liquid sprayed through the spray nozzle 6 of 0.05 to 4.00 kg/cm², preferably as low as 0.05 to 1.00 kg/cm², and by widening the width of the slit 7 of the spray nozzle 6 to increase the amount of quenching liquid to be sprayed therethrough.

The spraying angle of the quenching liquid from the slit 7 of said spray nozzle 6 is preferably within the range of 45° to 75° downward against the strip 1 in moving substantially vertically downward. A case with a spraying angle of 45° is represented in FIG. 2. A spraying angle of under 45° causes an upward flow of the quenching liquid, against the travelling direction of the strip 1, on quenching liquid's impinging against the strip 1, thus resulting in a non-uniform quenching of the strip 1 in the width direction thereof on substantially the same horizontal level, and hence in the occurrence of quench stains. It is necessary to increase said spraying angle accordingly as the quenching liquid pressure is raised within the above-mentioned range. At a spraying angle of over 75°, however, the impact of the quenching liquid against the strip 1 is insufficient to prevent the occurrence of quench stains.

As mentioned above, said two spray nozzles 6 are installed one opposite the other symmetrically on both sides of the strip 1 as it moves substantially vertically downward, in parallel therewith and on substantially the same horizontal level, in the air below the heating furnace 2 and above the surface of quenching liquid in the quenching tank 3.

The position where the quenching liquid sprayed through said spray nozzle 6 first comes in contact with the strip 1 to be quenched should be in the air below the heating furnace 2 and at least 25 mm above the surface of quenching liquid in the quenching tank 3. A distance of under 25 mm is not desirable because of the resultant entanglement of the air into the quenching liquid in the quenching tank 3.

It is necessary to ensure a sufficient amount of quenching liquid sprayed through said spray nozzles 6 in response to the heat contained in the strip 1. When the strip 1 contains too much heat, it is necessary to increase the amount of sprayed quenching liquid by changing the width of the slit 7 and/or the spraying angle of the spray nozzles 6.

In the present invention, streams of quenching liquid are sprayed, in the air, onto both surfaces of a continuously electrolytic tin-plated, having a tin-plated layer fused by heating, with the use of two spray nozzles of the above-mentioned construction and under the above-mentioned conditions. It is therefore possible to solve the non-uniform distribution of quenching liquid, i.e., the non-uniform quenching at portions of overlapping streams of quenching liquid sprayed from adjacent spray nozzles, which has been a difficulty in the conventional method, and thus to uniformly quench both surfaces of said strip over the entire width thereof on substantially the same horizontal level, this preventing the occurrence of quench stains. According to the present invention, furthermore, splashing can be prevented, even with a large amount of sprayed quenching liquid, by adjusting the slit width and the spraying angle of the spray nozzles, as mentioned above. It is therefore possible to achieve a sufficient quenching without spraying quenching liquid below the surface of quenching liquid in the quenching tank.

Now, the strip 1 quenched in the air as mentioned above is then immediately directed into the quenching liquid in the quenching tank 3, and, after being quenched to a desired temperature in said quenching tank 3, moves to outside the quenching tank 3 through the sinker roller 4 and is sent to the next process. The quenching liquid in the quenching tank 3 is fed through the inlet 3a into said quenching tank 3 and discharged by overflowing through the outlet 3b. In cases where the strip 1 contains too much heat, including, for example, cases with a very high line speed, with a large thickness of the strip 1, and with a high heating temperature in the heating furnace 3, it is advisable to promote quenching of said strip 1 in the quenching tank 3 by spraying supplemental streams of quenching liquid from the submerged spray nozzles 6' installed below the surface of quenching liquid in the quenching tank 3 onto both surfaces of said strip 1.

Now, the present invention is described further with reference to some embodiments.

EXAMPLE 1

On an experimental electrolytic tinning line, a continuously electrolytic tin-plated steel strip 1, having a tin-plated layer fused by heating in a heating furnace 2, and moving substantially vertically downward, was quenched under the conditions given in Table 1 in the air above the surface of quenching liquid in a quenching tank 3, and then, immediately, said strip 1 was further directed substantially vertically downward through the quenching liquid in said quenching tank 3 to quench further, with the use of a quenching apparatus comprising two spray nozzles 6 of the present invention as described above with reference to FIGS. 2, 3 and 4; provided, however, that no quenching liquid was sprayed in the quenching liquid in said quenching tank 3. A steel tube having an outside diameter of ¾ inch was used as inner tube 6a of the spray nozzle 6, and one with an outside diameter of 1½ inches, as the outer tube 6b.

Occurrence of quench stains on the surface of the tin-plated layer of said strip 1 was observed after quenching. In Table 1, Test No. 2 outside the scope of the present invention with a pressure of the quenching liquid sprayed through spray nozzles 6 of 0.03 kg/cm² showed the occurrence of quench stains over the entire surface of the tin-plated layer. In Tests Nos. 1 and 3 within the scope of the present invention, in contrast, there was no occurrence of quench stains, with a beautiful exterior appearance.

Table 1

| Conditions | Test No. 1 | No. 2 | No. 3 |
|---|---|---|---|
| Strip | | | |
| Thickness (mm) | 0.21 | 0.32 | 0.32 |
| Width (mm) | 200 | 200 | 200 |
| Tin-plating (lb/B.B.) weight | 0.25 | 0.25 | 0.25 |
| Line speed (m/min) | 100 | 100 | 100 |
| Spray nozzle | | | |
| Slit width of outer tube (mm) | 1 | 2 | 2.5 |
| Spraying angle (° ) | 60 | 60 | 60 |
| Sprayed quenching liquid | | | |
| Pressure (kg/cm²) | 0.1 | 0.03 | 0.2 |
| Flow rate (l/m²/min) | 1.4 | 4.2 | 7.8 |
| Temperature (° C) | 70 | 60 | 60 |
| Contact point of sprayed quenching liquid with strip (upward distance from the surface of quenching liquid in quenching tank) (mm) | 25 | 25 | 25 |

EXAMPLE 2

A continuously electrolytic tin-plated steel strip 1, having a tin-plated layer fused by heating in a heating furnace 2, and moving substantially vertically downward, was quenched under the conditions given in Table 2 in the air above the surface of quenching liquid in a quenching tank 3, and then, immediately, said strip 1 was further directed substantially vertically downward through the quenching liquid in said quenching tank 3 to quench further, with the use of a quenching apparatus similar to that used in Example 1; provided, however, that no quenching liquid was sprayed in the quenching liquid in said quenching tank 3. A steel tube having an outside diameter of 4 inches was used as the inner tube *6a* of the spray nozzle 6, and one with an outside diameter of 6 inches, as the outer tube *6b*.

Occurrence of quench stains on the surface of the tin-plated layer of said strip 1 was observed after quenching. In table 2, all of Tests Nos. 1 to 6 within the scope of the present invention, showed no quench stain with a beautiful exterior appearance.

Table 2

| Conditions | Test No. 1 | No. 2 | No. 3 | No. 4 | No. 5 | No. 6 |
|---|---|---|---|---|---|---|
| Strip | | | | | | |
| Thickness (mm) | 0.21 | 0.21 | 0.23 | 0.23 | 0.26 | 0.32 |
| Width (mm) | 700 | 700 | 909 | 909 | 710 | 710 |
| Tin-plating weight (lb/B.B.) | 0.25 | 0.25 | 0.25 | 0.25 | 0.25 | 0.25 |
| Line speed (m/min) | 300 | 300 | 300 | 300 | 200 | 300 |
| Spray nozzle | | | | | | |
| Slit width of outer tube (mm) | 3.8 | 4.0 | 3.8 | 4.0 | 5.0 | 5.0 |
| Spraying angle (° ) | 60 | 60 | 60 | 60 | 60 | 60 |
| Sprayed quenching liquid | | | | | | |
| Pressure (kg/cm²) | 0.05 | 0.15 | 0.05 | 0.15 | 0.05 | 0.1 |
| Flow rate (l/m²/min) | 9.4 | 14.2 | 9.4 | 14.2 | 11.0 | 14.0 |
| Temperature (° C) | 65 | 65 | 60 | 60 | 60 | 60 |
| Contact point of sprayed quenching liquid with strip (upward distance from the surface of quenching liquid in quenching tank) (mm) | 50 | 50 | 105 | 105 | 100 | 70 |

According to the present invention, as described above in detail, it is possible to uniformly quench both surfaces of a continuously electrolytic tin-plated steel strip, having a tin-plated layer fused by heating, on the same horizontal level over the entire width thereof. It is therefore possible not only to impart a beautiful gloss by perfectly preventing the occurrence of quench stains on the surface of the tin-plated layer of the strip, but also to permit speeding-up of a quenching line with a simple equipment at a low installation cost, thus providing industrially useful effects.

What is claimed is:

1. In a method for continuously quenching a moving, continuously electrolytic tin-plated steel strip while preventing quench stains, which comprises spraying streams of quenching liquid uniformly onto both surfaces of a continuously electrolytic tin-plated steel strip, having a tin-plated layer fused by heating in a heating furnace, and moving substantially vertically downward from said heating furnace, said streams of quenching liquid being sprayed on substantially the same horizontal level over the entire width of said strip, in the air below said heating furnace and above the surface of a quenching liquid in a quenching tank located below said heating furnace, thereby quenching said strip to solidify said fused tin-plated layer; and then, immediately, directing said strip further substantially vertically downward and passing said strip through the quenching liquid in said quenching tank, thereby further quenching said strip; the improvement which comprises: spraying the streams of quenching liquid uniformly onto both surfaces of said strip from two spray nozzles under the following conditions:

1. Spraying angle of the quenching liquid from said spray nozzles: from 45° to 75° downward against said strip,
2. Pressure of the quenching liquid sprayed from said spray nozzles: from 0.05 kg/cm² to 4.0 kg/cm², and
3. Position where the quenching liquid sprayed from said spray nozzles first comes in contact with said strip: in the air below said heating furnace and at least 25 mm above the surface of quenching liquid in said quenching tank;

said spray nozzles being of double-tube construction based on the concentric combination of an inner tube and an outer tube, said spray nozzles having a longitudinal slit of a length substantially equal to the width of said strip through which the streams of quenching liquid are sprayed onto said strip, and said spray nozzles being located one opposite the other symmetrically on both sides of said strip moving substantially vertically downward, in parallel therewith and on substantially the same horizontal level, in the air below said heating furnace and above the surface of quenching liquid in said quenching tank.

2. The method of claim 1, wherein the pressure of the quenching liquid sprayed through said spray nozzles is within the range of from 0.05 kg/cm² to 1.00 kg/cm².

* * * * *